US005937883A

United States Patent [19]

Camara

[11] Patent Number: 5,937,883

[45] Date of Patent: Aug. 17, 1999

[54] PORTABLE ENVIRONMENTAL BARRIER APPARATUS

[76] Inventor: Kevin Camara, 534 Edelweiss Dr., San Jose, Calif. 95136

[21] Appl. No.: 09/020,459

[22] Filed: Feb. 9, 1998

Related U.S. Application Data

[60] Provisional application No. 60/037,876, Feb. 10, 1997, and provisional application No. 60/045,368, May 2, 1997.

[51] Int. Cl.[6] ..... E04H 15/02; A45F 4/04

[52] U.S. Cl. ..... 135/87; 135/97; 135/902; 135/114; 224/153; 190/109; 160/135

[58] Field of Search ..... 135/87, 97, 900, 135/901, 902, 114, 115, 117; 256/25; 224/154, 153; 160/135; 190/109, 101, 110

[56] References Cited

U.S. PATENT DOCUMENTS

| | | | |
|---|---|---|---|
| 39,150 | 7/1863 | Joubert | 135/87 X |
| 109,166 | 11/1870 | Achenbach | 135/87 X |
| D. 376,636 | 12/1996 | Betz | D21/253 |
| 2,208,458 | 7/1940 | Julian et al. | 135/87 X |
| 2,771,088 | 11/1956 | Soldan | 135/87 X |
| 3,537,688 | 11/1970 | Stein | 256/24 |
| 4,576,364 | 3/1986 | O'Fearna | 256/24 |
| 4,606,070 | 8/1986 | Schachter | 383/4 |
| 4,621,653 | 11/1986 | Aquino | 135/117 |
| 4,778,090 | 10/1988 | Facchina | 224/153 |
| 4,860,777 | 8/1989 | Orlando | 135/902 X |
| 4,969,500 | 11/1990 | Makosa | 160/135 |
| 5,033,719 | 7/1991 | Cardente | 256/24 |
| 5,054,507 | 10/1991 | Sparks | 135/97 |
| 5,062,234 | 11/1991 | Green | 43/1 |
| 5,211,288 | 5/1993 | Beall | 190/109 X |
| 5,577,611 | 11/1996 | Greenall | 190/101 X |
| 5,649,658 | 7/1997 | Hoffman et al. | 224/153 X |

FOREIGN PATENT DOCUMENTS

| | | | |
|---|---|---|---|
| 261102 | 6/1963 | Austria | 135/87 |

*Primary Examiner*—Carl D. Friedman
*Assistant Examiner*—Winnie Yip
*Attorney, Agent, or Firm*—Larkin, Hoffman, Daly & Lindgren, Ltd.

[57] ABSTRACT

A portable barrier apparatus is disclosed in this specification defining a multi-sectioned barrier for protection against wind and sand in various outdoor environments. Additionally the barrier may assembled and used as a child or pet restraint enclosure, a privacy barrier, or a temporary personal effect storage site. The apparatus includes a connected plurality of flexible barrier panel members which may be supported in an upright manner with a plurality of pole members. The apparatus further includes a bag or similar device for transporting the barrier in an undeployed configuration. The invention provides that the bag can be independently utilized away from the barrier. The invention further provides an accessory enclosure structure which is attachable to the barrier.

19 Claims, 7 Drawing Sheets

PORTABLE ENVIRONMENTAL BARRIER APPARATUS

CROSS REFERENCE TO RELATED APPLICATIONS

This application claims the benefit of priority pursuant to 35 USC §119(e)(1) from the provisional patent applications filed pursuant to 35 USC §111(b): as Ser. No. 60/037,876 on Feb. 10, 1997, and as Ser. No. 60/045,368 on May 2, 1997.

BACKGROUND OF THE INVENTION

1. Field of the Invention

The field of the present invention relates generally to improvements in portable environmental barriers, and more particularly to a portable screen that can be easily carried by a user in a compact configuration. Portable screen barriers are particularly useful in outdoor environments to provide protection from blowing dirt, sand, and other debris. When used as a wind barrier, these devices are especially useful in beach environments, where wind blown sand and other debris may be a nuisance. Alternative uses for the portable environmental barrier of the present invention include a child or pet restraint enclosure, a privacy barrier, and a temporary equipment and personal effect storage site.

2. Brief Discussion of the Prior Art

The use of portable screen apparatusses in various environments is known in the prior art. In an outdoor environment, the use of environmental screens is desirable to prevent wind-blown dirt, sand, and other debris from contacting the user thereof or otherwise being deposited on or near the user. Additionally, environmental screens may desirably provide a degree of privacy to a user or group of users. Prior art environmental screens may be large fixed screens typically in the form of walls or fences. While such fixed screens are effective in providing protection against the wind and blowing objects, they are of course expensive, stationary structures which are impossible to transport. As a result, for those who find themselves outdoors on windy days either move to the shelter of a fixed wind fence or else suffer the discomfort and inconvenience of wind and blowing dirt and sand.

BRIEF SUMMARY OF THE INVENTION

The present invention specifically addresses the above mentioned deficiencies of the prior art wind screens. More particularly, and in illustrated embodiments, the present invention is a portable environmental barrier for outdoor use which can be stowed and user-carried within a "duffle-bag" or similar flexible bag appliance. The environmental barrier of the present invention may easily be carried by a user when packaged in a non-functional configuration within the bag, and deployed in a functional configuration to adequately protect the user from blowing grass, sand, and other debris. Additional uses for the present invention include a child or pet restraint enclosure and a privacy screen. Still another use for the present invention is as an enclosure for equipment and personal effects for members of a team participation event. A banner or other indicia may be associated with separate enclosures of the present invention to identify particular teams, groups, etc. Advantageously, the portable barrier of the present invention can be quickly erected for use in a wide variety of outdoor settings, e.g., beaches, sporting events, picnic areas, camping sites, etc. The portable environmental barrier includes a plurality of rectangular barrier panel members, which preferably may be formed from a single sheet of light weight fabric or other flexible material. The barrier panel members are supported in a generally vertical plane by support members which are secured at intervals along the length of the environmental barrier. The support members may be multi-part poles which may be deployed from a collapsed storage orientation. Still another aspect of the present invention provides that the barrier panel members, when transported or stored, may be folded or otherwise accumulated for user transport within a bag. The bag device may be separable from the environmental barrier device to allow individual use once the environmental barrier is erected. The bag device may include a plurality of pockets or enclosures for user storage. Still another aspect of the present invention provides accessory enclosure panels which may be attached to the erected environmental barrier to form a substantially enclosed region for additional privacy, protection from the sun, or storage of personal effects and the like.

DETAILED DESCRIPTION OF THE PREFERRED EMBODIMENTS

Figure 1:
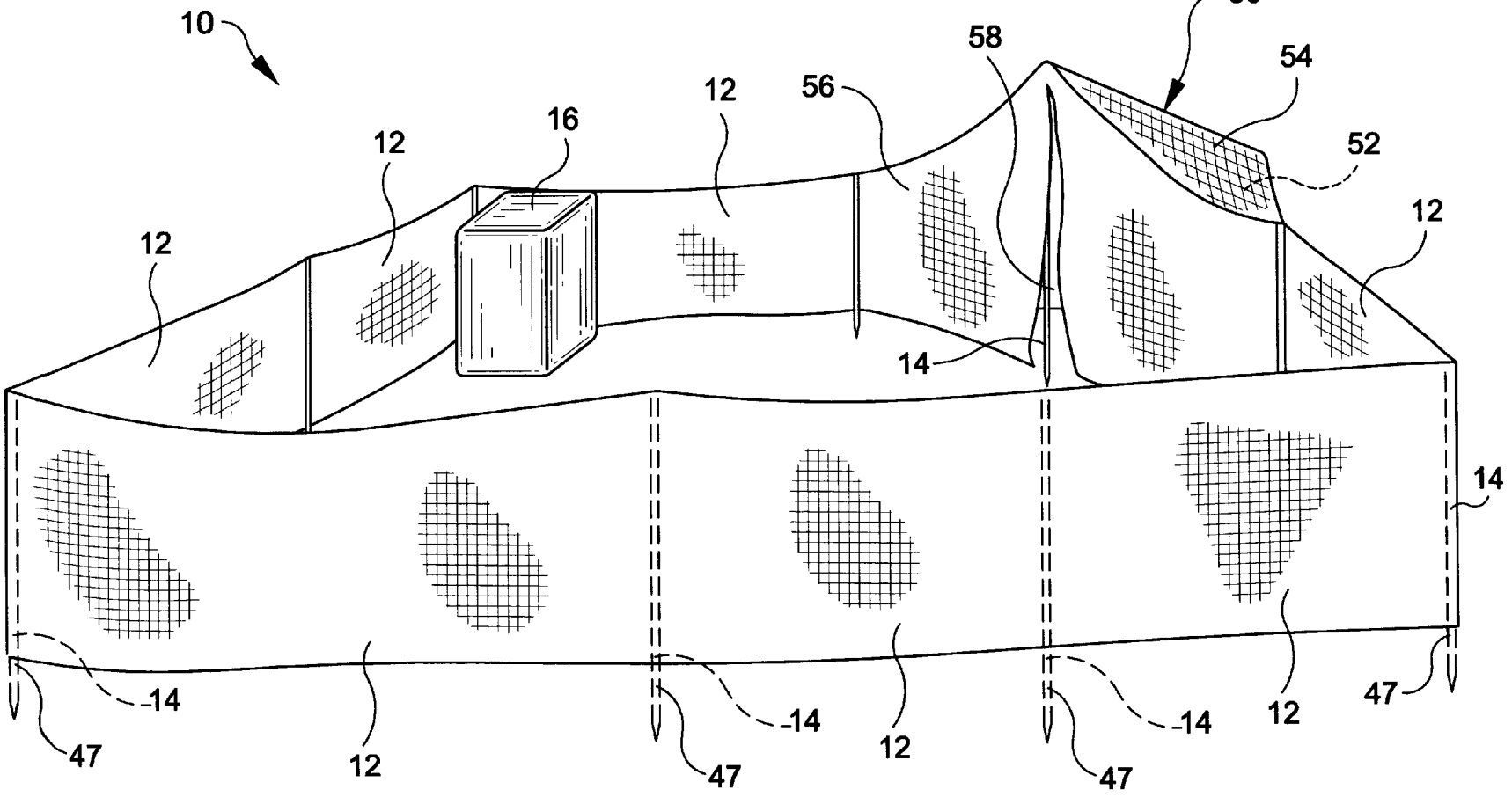
FIG. 1 is perspective view of a deployed environmental barrier according to the present invention.
Figure 2:
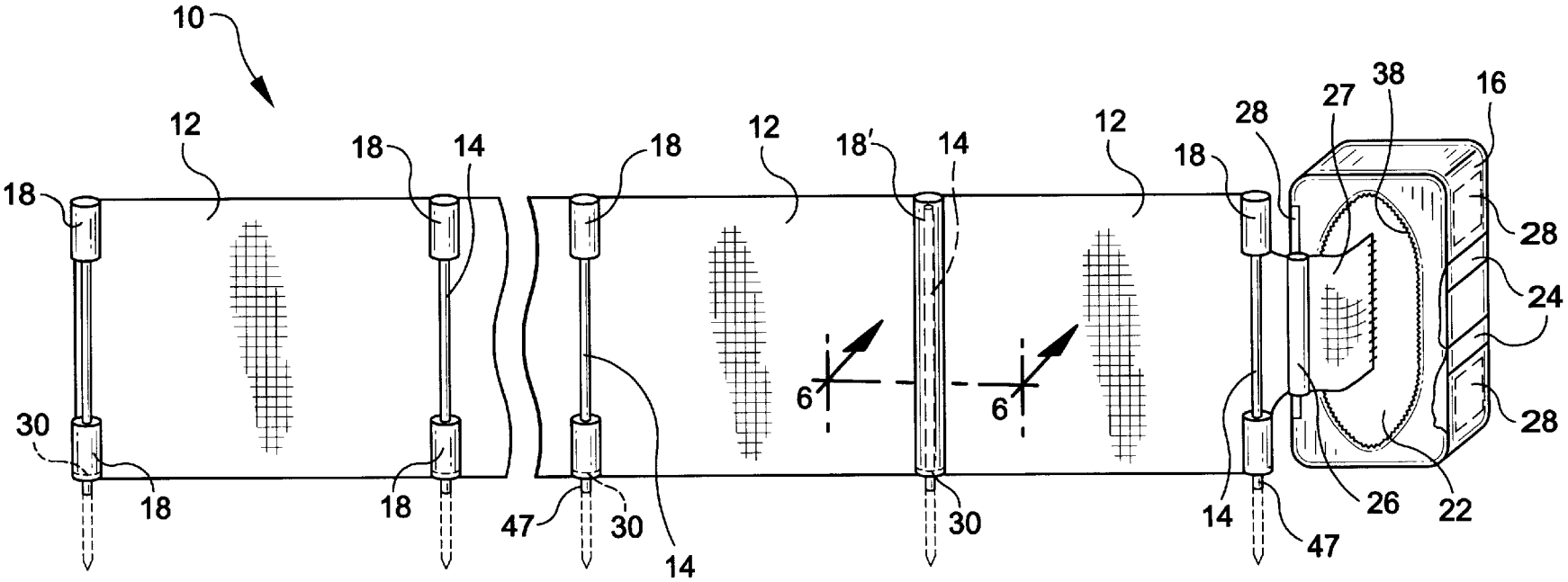
FIG. 2 is a side elevational view of an environmental barrier according to the present invention shown in an alternative deployed configuration.
Figure 3:
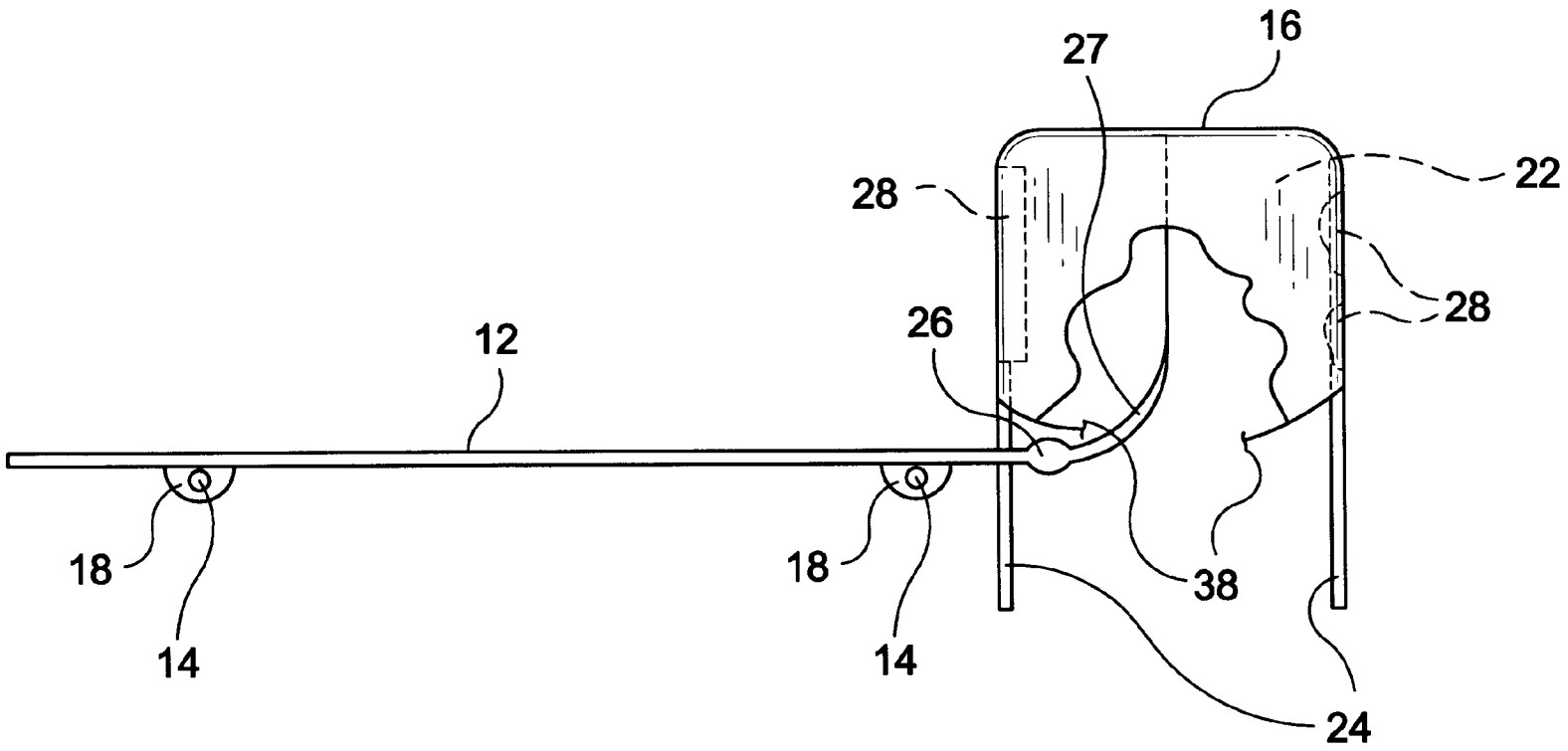
FIG. 3 is a partial top plan view of the environmental barrier of FIGS. 1 and 2.

Referring to the drawings in detail, the numeral 10 designates the environmental barrier device as a whole. The environmental barrier device 10 is illustrated in deployed orientations in FIGS. 1 and 2. As best illustrated in FIG. 1, the environmental barrier 10 includes a plurality of flexible barrier panel members 12 which are supported in generally vertical planes by pole members 14, shown here as collapsible poles 14. Device 10 further includes a bag device 16 or similar user-carried appliance which is adapted to contain the plurality of barrier panel members 12 and pole members 14. Bag device 16, as illustrated in FIG. 2, may also be supported by poles 14 in an upright manner. Alternatively bag device 16 may be detached from the environmental barrier structure 10 and separably utilized. Environmental barrier 10 may be erected upon sand other soil types in a variety of functional configurations. For instance, the environmental barrier 10 shown in FIG. 1 has been erected to enclose an area within the environmental barrier 10. Such a configuration may be desired to provide a degree of privacy to the user or provide a safety enclosure for children or pets. The deployed configuration of the barrier 10 of FIG. 1 may also be used as an equipment deposit site or team gathering location for outdoor team events. Alternatively with reference to FIG. 2, the environmental barrier 10 may be linearly erected, i.e. used as a wind fence structure.

Figure 6:
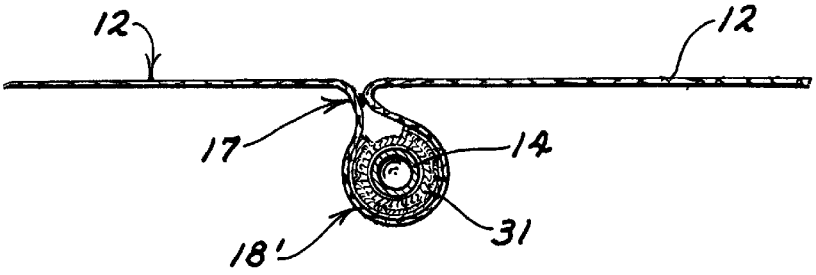
FIG. 6 is a cross sectional view of the environmental barrier of FIG. 2, taken along lines 6—6.

Referring to FIGS. 1 and 2, environmental barrier 10 is illustrated in deployed functional orientations. Individual barrier panel members 12 may be manufactured from flexible material or fabric alternatives. In one embodiment, a single length of rip-stop nylon may be used as the barrier panel members 12. Barrier panel members 12 are supported at either end by poles 14 which interact with support structures 18. In the illustrated embodiments, support structures 18 are sleeves being orthogonally aligned relative to the longitudinal extent of each barrier panel member 12. Referring to FIGS. 2 and 6, individual support structures 18' may alternatively be formed by a pinch and sew procedure 17 to form a light fitting sleeve 18' for the poles 14 to slide through and support the barrier panel members 12. Furthermore, it is appreciated that support structures 18 may be formed in a variety of manners so that the barrier panel members 12 can be supported by poles 14. For instance, the poles 14 may be received through elongated sleeves 18' that span the height of the barrier panel members 12. As still further examples, support structure 18 may include loops through which poles 14 may be threaded, hook and loop fastener loops or tabs, and other securing structure for temporarily maintaining contact between a pole 14 and a barrier panel member 12. As a result, a variety of pole 14/barrier panel member 12 support interface techniques are appreciated by those skilled in the art.

Still referring to FIGS. 1 and 2, device 10 of the present invention includes a detachable bag 16. Bag 16 includes a body 20 having an interior region 22 and a handle structure 24 adapted for grasp by a user. The interior region 22 of the bag 16 is preferably sized to receive the undeployed plurality of barrier panel members 12 and support poles 14. Bag 16 is temporarily attached to the barrier panel member 12 by securement structure including a flexible securement panel 27 and an attachment structure 26, which may be a zipper, buttons, a hook and loop type fastening system, or other known fastening structure. The bag 16 may be detached from the barrier structure 12 and separably utilized for carrying or storage purposes. Alternatively, as illustrated in FIG. 2, the bag 16 may remain secured to the barrier panel members 12 and be supported in an upright manner by a pole support 14 and support structure 18. Still additionally the bag 16 may include pockets or insulated regions 28 for storage of food, personal effects, or accessories which are readily accessible to the user within the barrier 10 enclosure. The bag device 16 is illustrated as a soft-sided, "duffle" style bag, though alternatively a variety of bag styles, configurations, and shapes may be practicably adapted for use with the present invention.

Figure 4:
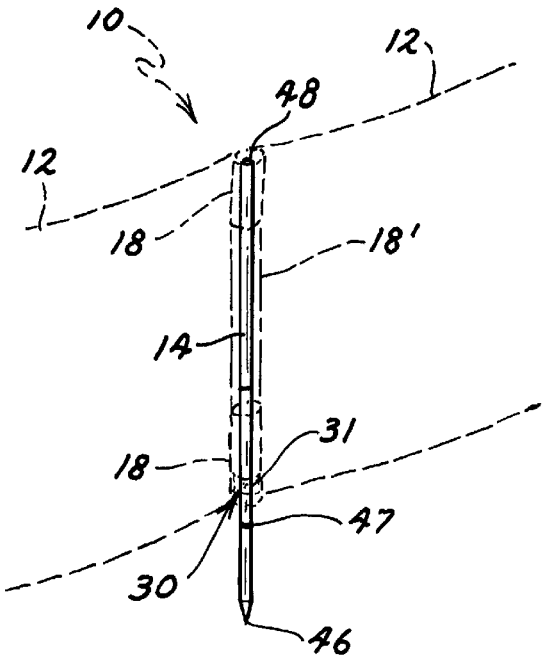
FIG. 4 is an enlarged partial perspective view of the environmental barrier of FIGS. 1 and 2.

Referring now to FIGS. 2, 4, and 6, the device 10 further includes a plurality of fastening structure 30 for temporarily securing the barrier panel members 12 to the poles 14. The fastening structure 30, which facilitates maintaining the barrier panel members 12 upon the pole 14 during use, may be a hook and loop fastener 31 affixed to the pole 14 and an inner surface of the support structure 18. Alternatively, the fastening structure 30 may include a small hook fastened to the pole 14 and engaging the barrier panel member 12 near its lower edge (not shown). Other types of fastening structure 30 may be appreciated by those skilled in the art.

Figure 5:
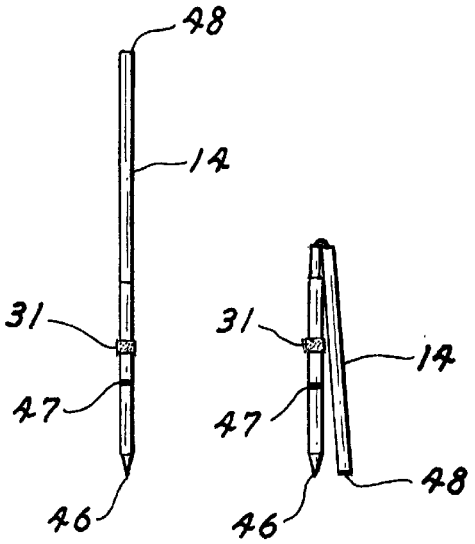
FIG. 5 is a side elevation view of the pole members of the present invention.

Referring now to FIG. 5, a pair of poles 14 are shown, illustrating the functional and non-functional configurations for the poles 14. Poles 14 are collapsible two-part poles 14 as well known in the art. Each pole member 14 has a sharpened end 46 for soil penetration and a blunt end 48 for applying a downward penetrating force. As shown in FIGS. 2, 5, and 6, each pole member 14 may include a depth indicia 47 for indicating to the assembler the desired depth to which the pole 14 is inserted into the soil. Depth indicia 47 may be a line marking on the pole 14, an O-ring secured to the pole, or any other visible marking(s). In an illustrated embodiment, depth indicia 47 is spaced approximately 8 inches away from a sharpened end 46 of a pole 14. Other muftiple-part poles 14 may be practicable. Furthermore, a variety of pole configurations and materials of construction may be selected.

Bag 16 may include additional pockets for accessory storage. It is readily appreciated that bag 16 can be user supported through handle structure 24. The bag 16 includes a sealing structure 38 for enclosing the barriers 12 within the bag 16. The sealing structure 38 may be a zipper, buttons, a hook and loop structure, or other known sealing devices.

Figure 7:
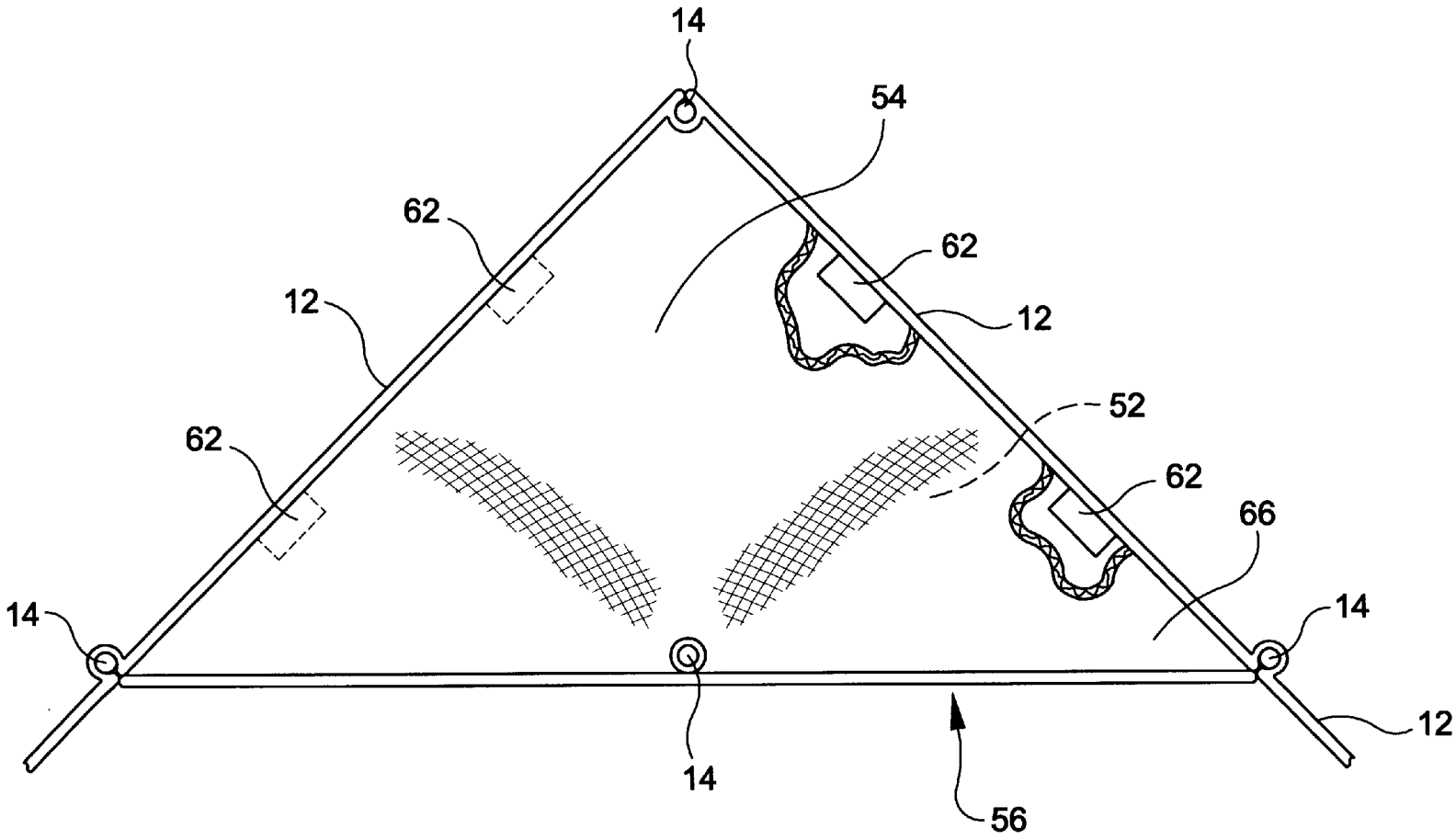
FIG. 7 is a partial top view of the environmental barrier of FIG. 1.
Figure 8:
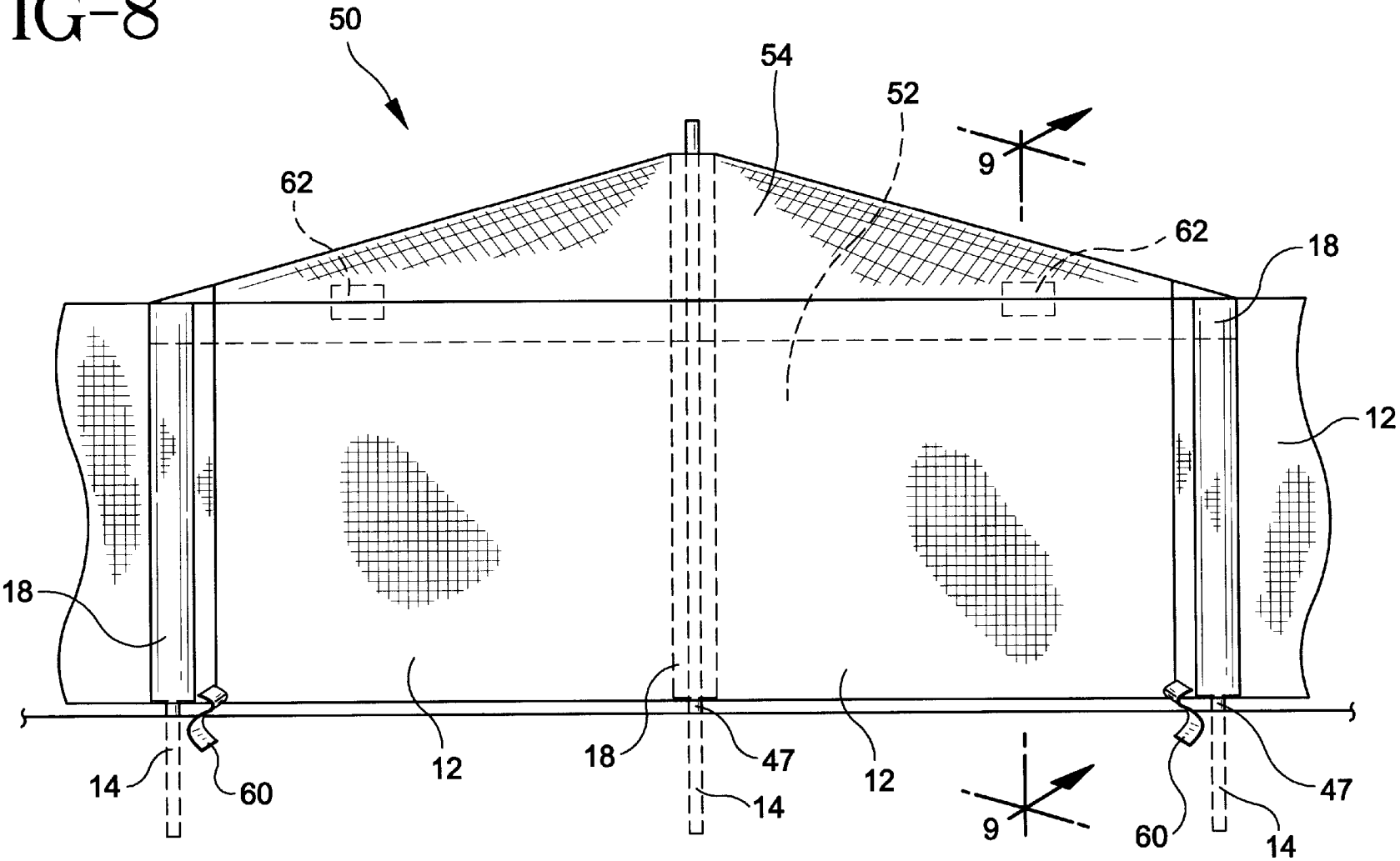
FIG. 8 is a partial side elevational view of the environmental barrier of FIG. 1.
Figure 9:
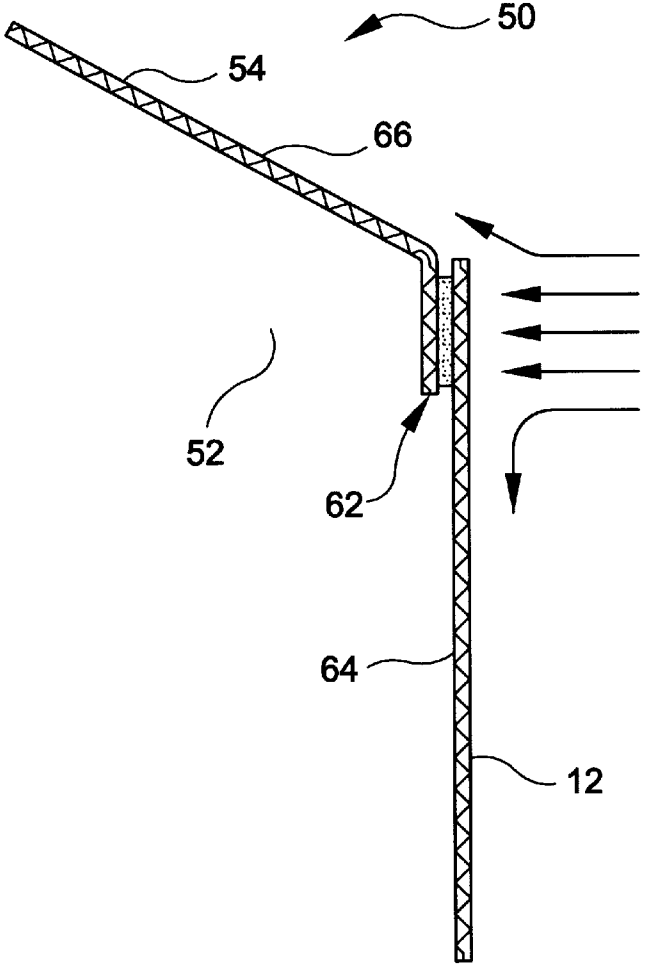
FIG. 9 is a cross sectional view of the environmental barrier of FIG. 8, taken along lines 9—9

Referring again to FIGS. 1, 7, 8, and 9, another aspect of the present invention includes an accessory enclosure structure 50 providing a substantially enclosed region 52 for additional user privacy or protection. As illustrated in FIGS. 7 and 8, accessory enclosure structure 50 may include a top, generally triangularly-formed panel 54 and a side panel 56 having an opening 58 for the user, both panels 54, 56 being supported by a support pole 14. In the embodiment illustrated in FIGS. 1, 7, and 8, the accessory enclosure panels 54, 56 are temporarily secured at a comer of the erected barrier panel members 12. The accessory enclosure panels 54, 56 may be secured to the barrier panel members 12 in a variety of known manners, e.g., zippers, buttons, hook and loop fasteners 60, etc. Alterative attachable accessory enclosure structures 50 are readily appreciated by those skilled in the art. With particular reference to FIGS. 7, 8, and 9, the top panel 54 is secured to the barrier panel members 12 with a hook and loop-type fastener 62 which is positioned between an inner surface 64 of the barrier panel members 12 and an outer surface 66 of top panel 54. Positioning the fastener 62 in this manner reduces the "billowing" effect of wind passing underneath the top panel 54 and into the enclosed region 52.

In operation, the user may transport the device 10 in the non-functional orientation within the bag 16 to an outdoor location. When desired the user releases the environmental barrier device 10 by opening the sealing structure 38 and un-rolling the plurality of barrier panels 12. The poles 14 are then extended or otherwise manipulated to length and individually inserted into the support structures 18 of the barrier panel members 12. The securement devices 30 are then fastened to maintain the barrier panel members 12 to the poles 14. The device 10 may then be erected in a variety of configurations, i.e., as an enclosure of FIG. 1, a fence illustrated in FIG. 2, etc., by inserting the sharpened portion 46 of the poles 14 into the soil a desired locations to a proper depth indicated by the pole depth indicia 47. The accessory enclosure structure 50 may next be erected by attaching the enclosure structure 50 at a corner of the plurality barrier panels 12 with fasteners 60, 62. User access to the interior region 52 of the enclosure structure may be made through the opening 58 in the side panel 56. If desired, the user may support the bag 16 with one or more poles 14 in a generally upright manner to form an additional wind barrier section and facilitate user access to the pockets within the bag 16. Alternatively, once the barrier panel members 12 are erected, the user may detach the bag 16 from the barrier panel members 12 and separably use the bag 16 for storage or transport or other use. Upon departure from the outdoor location the user may collapse the device 10, remove the poles 14 from the sleeves 18, fold or otherwise accumulate the plurality of barrier panel members 12, place the collapsed poles 14 in the inner pockets 34 of the bag 16, and enclose the barrier panel members 12 within the bag 16 with sealing structure 38.

It is understood that the exemplary portable environmental barrier 10 described herein and shown in the drawings represents only a presently preferred embodiment of the invention. Indeed, various modifications and additions may be made to such embodiment without departing from the spirit and scope of the invention. Thus, these and other modifications and additions may be obvious to those skilled in the art and may be implemented to adapt the present invention for use in a variety of different applications.

What is claimed is:

1. A user portable environmental barrier apparatus, said apparatus comprising:

a plurality of flexible barrier panel members, each of said barrier panel members being attached to at least one other of said barrier panel members, each of said plurality of flexible barrier panel members further having a pair of associated support structures;

a plurality of ground penetrable pole members engaging the support structures and supporting said plurality of flexible barrier panel members in an upright deployed configuration;

a bag defining an interior region, said interior region sized to receive the plurality of flexible barrier panel members and the plurality of pole members; and a flexible securement panel for securing the bag to at least one of the plurality of flexible barrier panel members, said securement panel including a first end coupled to the bag within the interior region and a second remote end having an attachment structure for releasably selectively attaching the bag to one of the plurality of flexible barrier panel members, said bag being releasably selectively detachable from said one of the plurality of barrier panel members so that the bag is independently utilizable away from the barrier panel members.

2. The apparatus according to claim 1, wherein the support structures are disposed between adjacent pairs of barrier panel members, wherein the support structures are cylindrical in form and include a top sleeve and a bottom sleeve, said top sleeve and bottom sleeve being sized to receive at least a portion of the pole members.

3. The apparatus according to claim 1, wherein the plurality of flexible barrier panel members are formed from a single sheet of fabric.

4. The apparatus according to claim 1, wherein the bag further includes a support structure for receiving a ground penetrable pole member, said support structure and an associated pole member capable of supporting the bag in a generally upright manner.

5. The apparatus according to claim 1, wherein the attachment structure for selectively securing the bag to said one of the plurality of flexible barrier panel members is a zipper.

6. The apparatus according to claim 1, wherein the bag further includes a sealing structure for substantially enclosing the interior region from access.

7. The apparatus according to claim 1, further comprising:

an accessory enclosure structure formed of flexible panels and attachable to the plurality of flexible barrier panel members, said enclosure structure defining a substantially enclosed region when attached to the plurality of flexible barrier panel members.

8. The apparatus according to claim 1, wherein the bag is a fabric bag.

9. A user portable environmental barrier apparatus, said apparatus comprising:

a connected plurality of flexible barrier panel members, each of said plurality having one or more support structures;

a plurality of ground penetrable poles, said plurality of poles engaging said support structures of said barrier panel members and maintaining said barrier panel members in an upright deployed orientation;

a bag appliance defining an interior region, said interior region sized to receive the connected plurality of flexible barrier panel members in an undeployed state; and a flexible securement panel releasably selectively securing the bag appliance to at least one of the plurality of barrier panel members, said securement panel having a first end coupled to the bag appliance at the interior region and a second free end having a releasably selectively detachable structure for securing the bag appliance to the at least one of the plurality of barrier panel members, said bag appliance independently utilizable away from the plurality of flexible barrier panel members.

10. The apparatus of claim 9, wherein the interior region of the bag appliance is sized to receive the plurality of flexible barrier panel members.

11. The apparatus according to claim 9, Wherein one or more of the plurality of poles is individually collapsible to a reduced height, and wherein the interior region of the bag appliance is sized to received said one or more of the plurality of poles.

12. The apparatus according to claim 9, wherein one or more of the support structures is disposed between adjacent pairs of barrier panel members.

13. The apparatus according to claim 9, wherein the plurality of flexible barrier panel members are formed from a single sheet of fabric.

14. The apparatus according to claim 9, herein the bag appliance further includes a support structure for receiving a ground penetrable pole, said support structure and an associated pole capable of supporting the bag appliance in a generally upright manner.

15. The apparatus according to claim 9, wherein the securement device includes a zipper.

16. The apparatus according to claim 9, wherein the bag appliance further includes a sealing structure for substantially enclosing the interior region from access.

17. The apparatus according to claim 9, her comprising:

an accessory enclosure structure formed of flexible panels and attachable to the plurality of flexible barrier panel members, said enclosure structure defining a substantially enclosed region when attached to the plurality of flexible barrier panel members.

18. The apparatus according to claim 9, wherein the accessory enclosure structure includes a generally triangularly shaped top panel and a side panel having an opening for user access, wherein said top panel and said side panel may be secured to a corner portion of an enclosure defined by a deployed plurality of flexible barrier panel members.

19. The apparatus according to claim 9, wherein the bag appliance is a fabric "duffle"-style bag.

* * * * *